US007944136B2

(12) United States Patent
Inoue

(10) Patent No.: US 7,944,136 B2
(45) Date of Patent: May 17, 2011

(54) LIGHT EMITTER SUBSTRATE AND IMAGE DISPLAYING APPARATUS USING THE SAME

(75) Inventor: Yukihiro Inoue, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 197 days.

(21) Appl. No.: 12/478,551

(22) Filed: Jun. 4, 2009

(65) Prior Publication Data

US 2009/0310360 A1 Dec. 17, 2009

(30) Foreign Application Priority Data

Jun. 16, 2008 (JP) ..... 2008-156644

(51) Int. Cl.
*H01J 1/62* (2006.01)

(52) U.S. Cl. ..... 313/495; 313/310

(58) Field of Classification Search ..... 313/495, 313/310

See application file for complete search history.

(56) References Cited

U.S. PATENT DOCUMENTS

| | | | | |
|---|---|---|---|---|
| 2006/0103294 | A1 | 5/2006 | Suzuki et al. | 313/496 |
| 2007/0257599 | A1 | 11/2007 | Sato et al. | 313/495 |
| 2009/0184658 | A1 | 7/2009 | Inoue et al. | 315/219 |

FOREIGN PATENT DOCUMENTS

| | | |
|---|---|---|
| EP | 1 830 379 | 9/2007 |
| JP | 2006-173094 | 6/2006 |
| JP | 2006-185632 | 7/2006 |

*Primary Examiner* — Vip Patel

(74) *Attorney, Agent, or Firm* — Fitzpatrick, Cella, Harper & Scinto

(57) ABSTRACT

The invention aims to improve, in a light emitter substrate having a resistor for connecting row-direction adjacent electrodes, withstand discharge performance of the resistor. The light emitter substrate comprises a substrate, plural light emitting members positioned in matrix on the substrate, plural electrodes positioned in matrix and each covering at least one of the light emitting members, and a row-direction striped resistor positioned between the column-direction adjacent electrodes and connecting the row/column-direction adjacent electrodes. A row-direction separated distance between the row-direction adjacent electrodes in a connecting portion between the electrodes and the resistor is larger than a row-direction separated distance between the row-direction adjacent electrodes in a portion covering the light emitting members at a position along a row-direction edge portion of the resistor, and is larger than a row-direction separated distance between the row-direction adjacent electrodes in the connecting portion at an edge portion in a column-direction end region.

4 Claims, 3 Drawing Sheets

LIGHT EMITTER SUBSTRATE AND IMAGE DISPLAYING APPARATUS USING THE SAME

BACKGROUND OF THE INVENTION

1. Field of the Invention

The present invention relates to a light emitter substrate and an image displaying apparatus which uses the light emitter substrate.

2. Description of the Related Art

Conventionally, an image displaying apparatus which comprises a rear plate substrate having plural electron-emitting devices arranged in matrix and a light emitter substrate having plural light emitting members arranged in matrix and opposed to the plural electron-emitting devices has been known. In the image displaying apparatus like this, the light emitter substrate and the rear plate substrate are typically opposed to each other at a gap of about several millimeters, and high voltage of, e.g., approximately 10 kV is applied between these substrates. For these reasons, a discharge occurs easily, and, if the discharge once occurs, a discharging current flows from the whole of a metal back which has been integrally formed, whereby an influence to the electron-emitting devices expands.

Consequently, in order to allow the image displaying apparatus of the above type to have a discharging current control function, Japanese Patent Application Laid-Open No. 2006-173094 (corresponding to United States Patent Application Publication 2006/0103294) and Japanese Patent Application Laid-Open No. 2006-185632 (corresponding to European Patent Application Publication No. 11830379) respectively disclose techniques for controlling a discharging current by two-dimensionally dividing a metal back and establishing a connection between the divided metal backs by a resistor.

However, if a discharge occurs in a case where further high voltage is applied to improve luminance, a potential difference between the adjacent metal backs increases, whereby there is a possibility that a secondary discharge occurs between the adjacent metal backs. Besides, if the resistor is arranged between the adjacent metal backs, a discharge voltage of a material of the resistor is lower than a creepage discharge voltage between the metal backs according to a kind of the relevant material, whereby there is a possibility that withstand discharge structure is destroyed. In particular, in an ordinary image displaying apparatus to be used for a TV monitor, since a distance between the metal backs adjacent in a horizontal direction (=a row direction) is small, the secondary discharge occurs easily. If the secondary discharge occurs, the discharging current increases, whereby there is a possibility that a damage such as device destruction or the like which is not preferable for image displaying occurs.

To cope with such a problem as described above, in Japanese Patent Application Laid-Open No. 2006-173094 and Japanese Patent Application Laid-Open No. 2006-185632, it is designed to define resistance in the row direction without arranging any resistor between light emitting members adjacent in the row direction. More specifically, Japanese Patent Application Laid-Open No. 2006-173094 discloses the structure that the metal back divided in matrix and the resistors patterned in matrix are combined, and any resistor is not arranged between the metal backs adjacent in the row direction. Further, the Japanese Patent Application Laid-Open No. 2006-185632 discloses the structure that the metal backs divided in matrix and striped resistors expanding in the row direction between the metal backs adjacent in a column direction are connected on the column side of the light emitting members.

However, in the light emitter substrate disclosed in the Japanese Patent Application Laid-Open No. 2006-173094, further improvement is desired in the points of definition of the resistance of the resistor and the discharge voltage of the material. Also, in the light emitter substrate disclosed in the Japanese Patent Application Laid-Open No. 2006-185632, structure of further weakening field intensity applied to the resistor by controlling the secondary discharge between the metal backs adjacent in the row direction is desired.

SUMMARY OF THE INVENTION

The present invention aims to improve, in a light emitter substrate which has a resistor for connecting electrodes adjacent in a row direction, withstand discharge performance of the resistor. Moreover, the present invention aims to provide an image displaying apparatus which uses the light emitter substrate like this.

A light emitter substrate according to an aspect of the present invention is characterized by comprising a substrate, plural light emitting members which are positioned in matrix on the substrate, plural electrodes each of which covers at least one of the light emitting members and which are positioned in matrix, and a row-direction striped resistor which is positioned between the electrodes adjacent to each other in a column direction and connects the electrodes adjacent to others in a row direction and the column direction. Here, a row-direction separated distance between the electrodes adjacent to each other in the row direction in a connecting portion between the electrodes and the resistor at a position along an edge portion extending in the row direction of the resistor is larger than a row-direction separated distance between the electrodes adjacent to each other in the row direction in a portion covering the light emitting members, and the row-direction separated distance between the electrodes adjacent to each other in the row direction in the connecting portion between the electrodes and the resistor at the position along the edge portion extending in the row direction of the resistor is larger than a row-direction separated distance between the electrodes adjacent to each other in the row direction in the connecting portion between the electrodes and the resistor at an edge portion in an end region extending in the column direction of the electrodes.

An image displaying apparatus according to another aspect of the present invention is characterized by comprising a rear plate substrate having plural electron-emitting devices, and the above-described light emitter substrate. Here, in the image displaying apparatus, the light emitting members of the light emitter substrate emit light in response to electrons emitted from the electron-emitting devices.

According to the present invention, in the light emitter substrate which has the resistor for connecting the electrodes adjacent in the row direction, it is possible to improve the withstand discharge performance of the resistor. Moreover, according to the present invention, it is possible to provide the image displaying apparatus which uses the light emitter substrate like this.

Further features of the present invention will become apparent from the following description of the exemplary embodiments with reference to the attached drawings.

DESCRIPTION OF THE EMBODIMENTS

Hereinafter, the exemplary embodiments of the present invention will be described with reference to the attached drawings.

Figure 1:
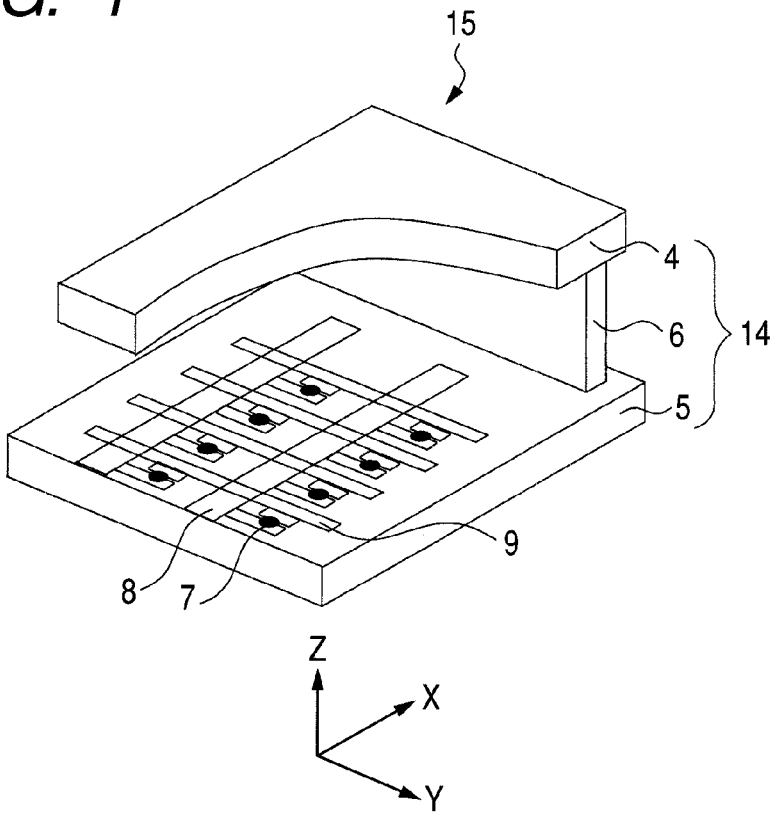
FIG. 1 is a partially broken oblique perspective view of an image displaying apparatus according to an embodiment of the present invention.

First of all, the basic constitution of an image displaying apparatus according to one embodiment of the present invention will be described with reference to FIG. 1. In FIG. 1, an image displaying apparatus 15 has a light emitter substrate 4 and a rear plate substrate 5 each of which has been made by rectangular glass and which are arranged oppositely at a distance of 1 mm to 2 mm. The peripheral portions of the light emitter substrate 4 and the rear plate substrate 5 are bonded to each other through a side wall 6 of a rectangular frame, whereby the light emitter substrate 4 and the rear plate substrate 5 constitute a flat rectangular vacuum envelope 14 of which the inside is maintained in high vacuum of about $10^{-4}$ Pa or less.

A number of electron-emitting devices 7 which emit electron beams to excite later-described light emitting members 1 are provided on the inner surface of the rear plate substrate 5. The electron-emitting devices 7 are arranged in matrix on plural columns and plural rows in correspondence with the light emitting members 1, and the arranged electron-emitting devices 7 are driven by a driving circuit (not illustrated) provided outside the vacuum envelope 14 through row-direction wirings 8 and column-direction wirings 9 which are arranged in matrix. Thus, the image displaying apparatus 15 is constituted by adding a not-illustrated power supply, the driving circuit and the like to the vacuum envelope 14.

Figure 2:
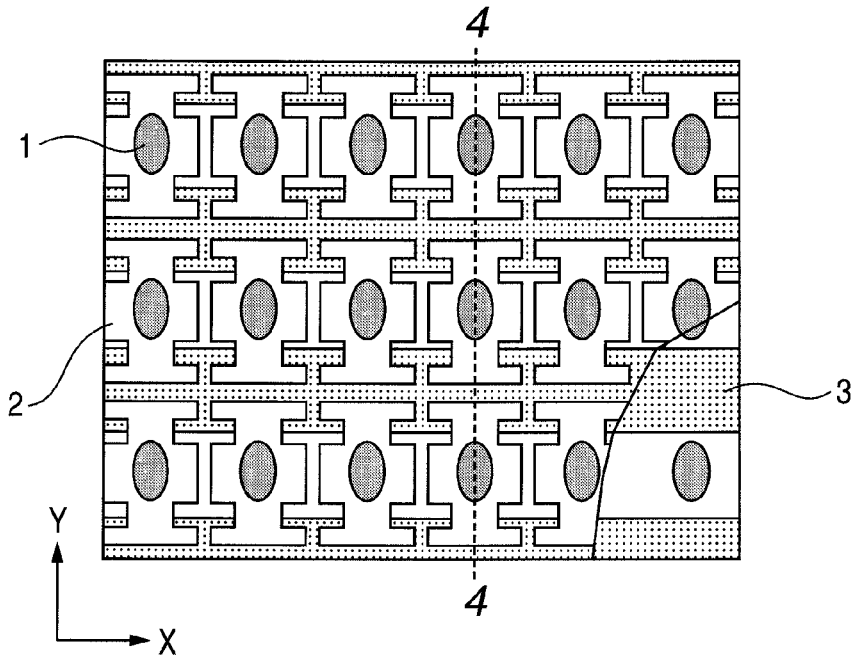
FIG. 2 is an internal plan view of a light emitter substrate of the image displaying apparatus illustrated in FIG. 1.
Figure 3:
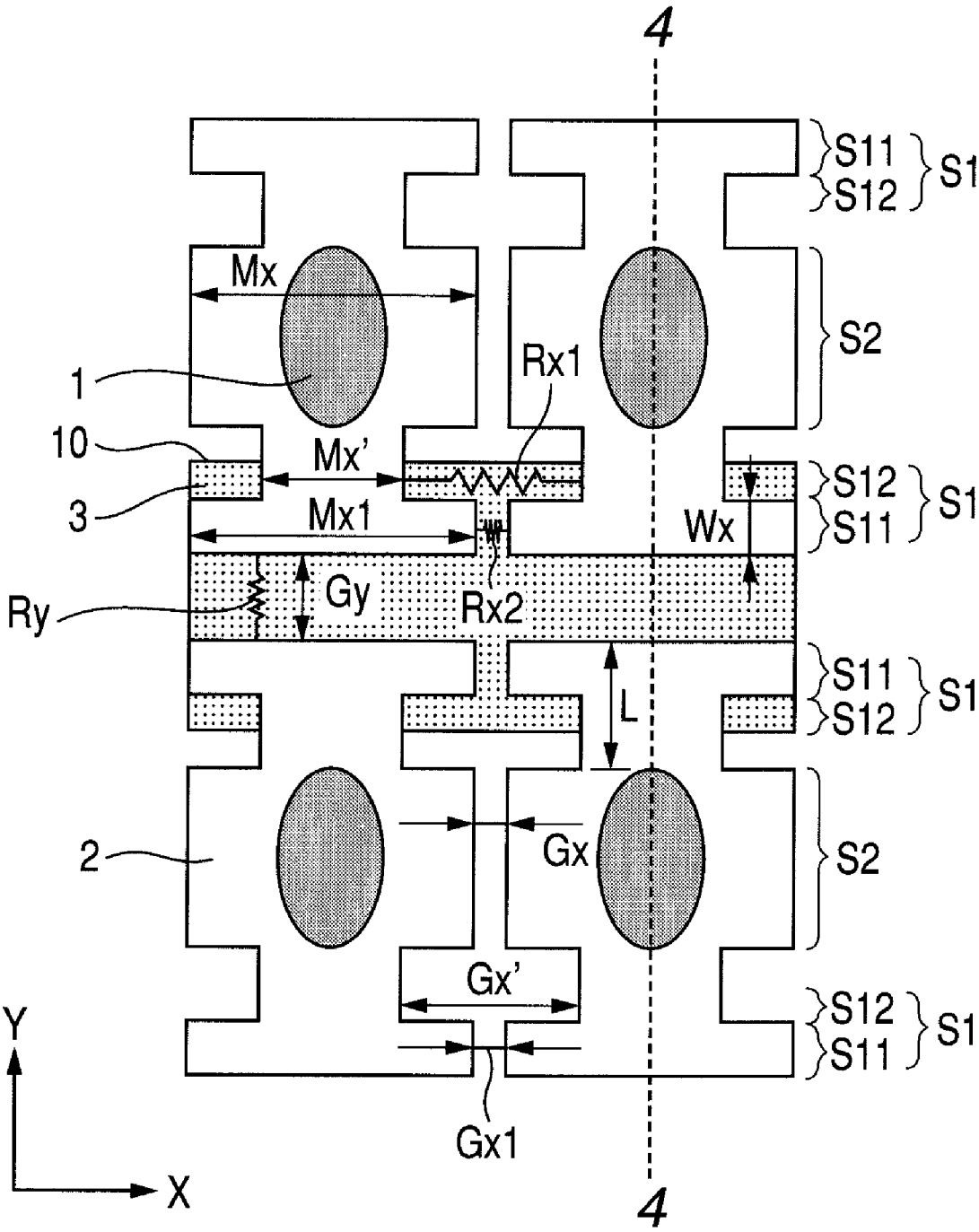
FIG. 3 is a partial enlarged view of the light emitter substrate illustrated in FIG. 2.
Figure 4:
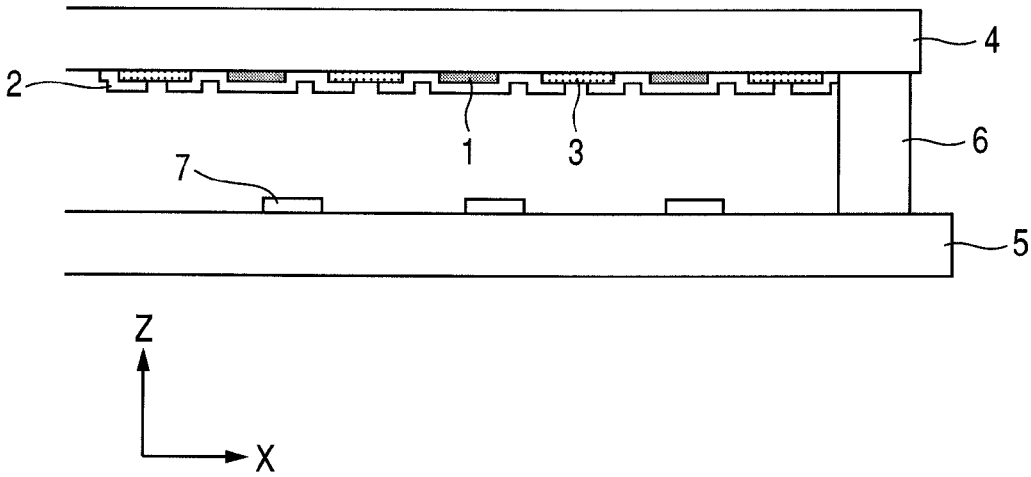
FIG. 4 is a cross section diagram illustrating the light emitter substrate along the 4-4 line in each of FIGS. 2 and 3.

FIG. 2 is an internal plan view of the light emitter substrate of the image displaying apparatus illustrated in FIG. 1, FIG. 3 is a partial enlarged view of the light emitter substrate illustrated in FIG. 2, and FIG. 4 is a cross section diagram illustrating the light emitter substrate along the 4-4 line in each of FIGS. 2 and 3. The lower right portion of FIG. 2 indicates the state that a metal back has been removed (that is, the state that the light emitting member and a resistor are exposed). Incidentally, although the light emitting members 1 are explicitly shown in the region other than the lower right portion in FIG. 2, FIG. 3 and later-described FIG. 5 so as to understand the physical relationship between the light emitting member 1 and a metal back layer (electrode) 2 functioning as an anode electrode in X and Y directions, the light emitting members 1 are basically covered with the metal back layer 2 (see FIG. 4). In any case, the constitution of the light emitter substrate 4 will be described with reference to these drawings.

The light emitting members 1 each of which is composed of a number of phosphors respectively emitting red (R), green (G) and blue (B) lights are positioned on the inner surface of the light emitter substrate 4. The image displaying apparatus 15 in the present embodiment is the image displaying apparatus of a typical landscape screen. If it is assumed that the long-axis direction is an X direction (row direction) and the short-axis direction is a Y direction (column direction), the light emitting members 1 are arranged in matrix at predetermined pitches in the X direction (row direction) and the Y direction (column direction). The R, G and B phosphors are repetitively arranged in the X direction (row direction). Here, it should be noted that "the predetermined pitches" include a case where arrangement pitches change within a range of manufactural error or a case where arrangement pitches change due to a design reason. Irrespective of monochrome or color, the light emitting members 1 can be formed by coating in a precipitation method, a screen printing method, a dispenser method or the like.

The metal back layer (electrode) 2 which functions as the anode electrode is formed on the light emitting member 1, and the metal back layers 2 are divided into the X direction (row direction) and the Y direction (column direction). That is, in the present embodiment, the one metal back layer 2 corresponds to the one light emitting member 1, and each metal back layer 2 covers the corresponding light emitting member 1 from the side of the inner surface of the image displaying apparatus 15. The metal back layers 2 are formed substantially on the whole of the substrate on which the light emitting members 1 are formed. Incidentally, the metal back layer 2 can be formed by a method (photolithography method) of patterning the layer by photo-etching. Alternatively, the metal back layer 2 may be formed by a method (mask vapor deposition method) of performing vacuum vapor deposition with use of, as a masking member, a metal mask having a predetermined aperture.

A resistor 3 which continuously extends in the X direction (row direction) is provided between the metal back layers (electrodes) 2 adjacent in the Y direction (column direction). As illustrated at the lower right portion of FIG. 2, the resistor 3 has a certain-width striped shape in the Y direction (column direction). Incidentally, the resistor 3 can be formed by the photolithography method, the screen printing method, the dispenser method or the like.

As illustrated in FIG. 3, in a connecting portion S1 between the metal back layer 2 and the resistor 3, the metal back layer 2 is formed so as to cover the resistor 3. Namely, the metal back layer 2 is superposed on the resistor 3. As a result, the metal back layers 2 adjacent in the X direction (row direction) are electrically connected to each other, and the metal back layers 2 adjacent in the Y direction (column direction) are electrically connected to each other. As described later, in the connecting portion S1 between the metal back layers 2 and the resistor 3, a narrow-width portion (a width is Mx') and a wide-width portion (a width is Mx1) in the X direction (row direction) are formed. As a result, resistors which are constituted as parallel resistors having a resistor Rx1 connecting the narrow-width portions to each other and a resistor Rx2 connecting the wide-width portions to each other are formed between the metal back layers 2 adjacent in the row direction (hereinafter, the relevant resistors may be called a parallel resistor Rx). Likewise, a resistor Ry is formed between the metal back layers 2 adjacent in the column direction. It should be noted that FIG. 3 schematically indicates such a constitution.

Incidentally, anode potential is supplied to the resistor 3 from a power supply (not illustrated) provided in the image displaying apparatus 15. Therefore, the metal back layer 2 is set to the anode potential through the resistor 3, electron beams emitted from the electron-emitting device 7 are accelerated by an anode voltage, and the accelerated electron beams collide against the light emitting member 1, whereby an image is displayed.

Figure 5:
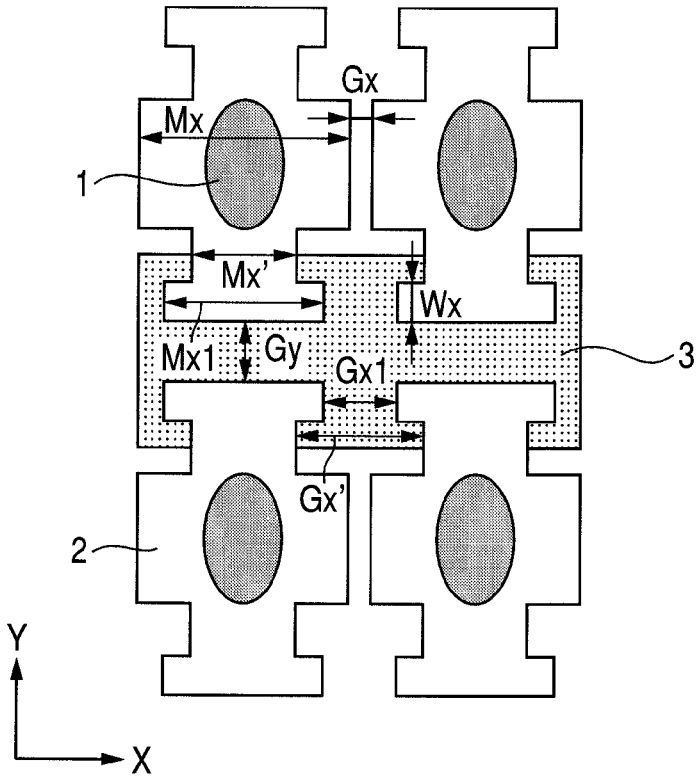
FIG. 5 is a partial enlarged view of a light emitter substrate according to another embodiment of the present invention.

A width Mx of the metal back layer 2 in the X direction (row direction) in a portion S2 covering the light emitting member 1 is formed so as to be larger than the width Mx' at the position along an edge portion 10 extending in the X direction (row direction) of the resistor 3. More specifically, the width Mx is formed so as to be larger than the width Mx' in a connecting portion S12 between the metal back layer 2 and the resistor 3 including the edge portion 10. As a result, a row-direction separated distance Gx' between the metal back layers 2 adjacent in the X direction (row direction) in the connecting portion S12 is larger than a row-direction separated distance Gx between the metal back layers 2 adjacent in the X direction (row direction) in the portion S2 covering the light emitting members. Further, in an end region S11 of the metal back layers 2 in the column direction, a row-direction separated distance Gx1 between the metal back layers 2 adjacent in the X direction (row direction) is formed so as to be smaller than the separated distance Gx' along the edge portion 10. Incidentally, it should be noted that the separated distance Gx1 is equal to the separated distance Gx in the present embodiment. However, as illustrated in FIG. 5, the separated distance Gx1 may be larger than the separated distance Gx. According to such a constitution as described above, an average separated distance between the metal back layers 2 adjacent in the X direction (row direction) can be secured largely in the connecting portion S1, whereby the resistance of the resistor Rx can be substantially set largely. More specifically, if a discharge occurs between a certain metal back and a certain electron-emitting device, electrons flow into the certain metal back from the adjacent metal back through the resistor 3. However, if the average separated distance between the adjacent metal backs is made large in the connecting portion S1 between the metal backs and the resistor 3, it is possible to easily secure the length of the resistor 3 in the row direction. For this reason, it becomes possible for the resistor 3 to withstand a potential difference between the adjacent metal back layers 2, whereby it is possible to further increase the voltage at the anode electrode. Therefore, it is possible to obtain the light emitter substrate capable of performing high-luminance image displaying. Incidentally, it should be noted that the separated distance Gx between the metal back layers 2 can arbitrarily be selected according to specifications of the discharge, circumstances of processes, and the like.

Further, since the number of the light emitter substrates to be arranged in the column direction is limited according to the number of scanning lines, there is a possibility that, according to an actual configuration, a column-direction separated distance Gy between the metal back layers 2 adjacent in the column direction is larger than the row-direction separated distance Gx between the metal back layers 2 adjacent in the row direction. In this case, the resistance of the resistor Ry is large. However, it is possible to decrease the column-direction separated distance Gy between the metal back layers 2 adjacent in the column direction and it is thus possible to decrease the resistance of the resistor Ry, by prolonging the end portion, that is, by making a length L of the connecting portion S1 in the Y direction (column direction) large.

In the present embodiment, the discharge voltage between the adjacent metal back layers 2 is determined based on the separated distances Gx' and Gx1 between the metal back layers in the connecting portion S1. If each of the metal back layers 2 is rectangular and thus each of the separated distances Gx' and Gx1 is equal to the separated distance Gx in the portion S2 covering the light emitting members 1, it is necessary to strictly adjust the resistor Rx by high-precision pattern formation of the resistor 3 and adequate resistor application. However, since the average separated distance between the adjacent metal back layers in the connecting portion S1 is larger than the separated distance Gx, an influence of accuracy in case of forming the resistor 3 to the resistance of the resistor Rx is reduced, whereby it is unnecessary to perform the high-precision pattern formation for the resistor 3. Further, since each of the separated distances Gx' and Gx1 can be determined irrespective of the arrangement pitches of the light emitting members 1, degree of freedom in adjustment is large. Furthermore, since it only has to form, as the resistor 3, a certain-width film extending in the X direction (row direction), it is possible to simplify manufacturing processes.

Besides, in the present embodiment, the region of which the width (Mx1) is wider than the width Mx' is provided at the column-direction end portion of the metal back layer 2. It is possible, by such a constitution, to obtain the following merits. That is, if it is assumed that the region of the wide width is not provided, the resistor Rx is highly dependent on the shape of the peripheral portion of the edge portion 10 of the resistor 3. However, since it is difficult to equally form the shape of the edge portion 10 of the resistor 3 in the row direction, the resistor may vary in width in the column direction and thickness of the edge portion 10 (for example, the edge portion of the resistor becomes saw-toothed), whereby there is a possibility that the resistance of the resistor Rx highly varies. On the other hand, in the present embodiment, the resistor Rx is constituted as the parallel resistor which consists of the resistor Rx1 for connecting the narrower-width portions mutually and the resistor Rx2 for connecting the wider-width portions mutually. The resistance of the resistor Rx1 easily varies due to the influence of the shape of the edge portion 10, but the resistance of the resistor Rx2 does not easily vary due to the influence of the shape of the edge portion 10. For this reason, by providing the resistor Rx2, it is possible to reduce the influence of variation of the resistor Rx1 to the resistor Rx. Therefore, since it is also possible to reduce the influence of the unevenness of the shape of the surface of the edge portion 10 of the resistor 3 along the row direction to the resistor Rx, it is possible to reduce variation of the resistance of the resistor Rx.

EXAMPLES

Example 1

The light emitter substrate having the constitution illustrated in FIGS. 2 to 4 was manufactured by the following process. As a glass substrate, a glass substrate of which the thickness is 2.8 mm (PD 200 manufactured by Asahi Glass Co., Ltd.) was used, and the NP-7803D (manufactured by Noritake Kizai Co., Ltd.) was formed on the PD 200 as a light shielding layer. Next, after the light emitting members 1 of R, G and B were applied and baked, the striped resistors 3 which extend in the row direction were formed by a dispenser application method. Additionally, the metal back layers 2 were formed on the light emitting members 1 by a photolithography method.

In this example, it was purposed that a discharge current between an anode electrode and an electron-emitting device is reduced to a level equal to or less than 1 A, a secondary discharge due to the potential difference to be generated when the discharge occurred between the separated metal back layers 2 is prevented and the luminance deterioration is made to reach an acceptable level by suppressing the anode potential drop at a time of driving to a level equal to or less than 250V. For this purpose, it is required to execute a manufacturing process with the resistance of Rx=250 kΩ and Ry=250 kΩ. These values were calculated by previously performing a calculation in an equivalent circuit model in which resistance, capacity, inductance and the like are two dimensionally linked. Required resistance values of the resistors Rx and Ry can be obtained by performing a calculation by previously planning the equivalent circuit model in accordance with the discharge current to be obtained, the potential difference generated between the adjacent metal backs and the luminance deterioration amount at a time of driving.

In this example, aluminum (Al) was used as the metal back layers 2, and the resistance values of Rx=250 kΩ and Ry=250 kΩ were realized. More specifically, with reference to FIG. 4, the width Mx in the row direction of the metal back layer 2 was formed with a width of 160 μm. In addition, the separated distance (Gx) between the metal back layers 2 adjacent to each other in the row direction was formed with a distance of 50 μm and the separated distance (Gy) between the metal back layers 2 adjacent to each other in the column direction was formed with a distance of 80 μm. Additionally, the resistive material, of which the volume resistance is 5 Ω·m, was used as the resistor 3, and the width in the column direction of the resistor 3 was formed with a width of 200 μm and the film thickness was formed with a thickness of 10 μm. The width of the metal back layer 2 at the boundary portion between the metal back layer 2 and the resistor 3 was locally narrowed, the width (Mx') in the row direction was formed with a distance of 60 μm, and a width (Wx) in the column direction at the end portion of the metal back layer 2 was formed with a distance of 50 μm. In this example, since the resistor 3 is formed at the end portion of the metal back layer 2, the resistance values of the resistors Rx and Ry are defined by the width and the length of the end portion of the metal back layer 2 and the distance between the end portions of the adjacent metal back layers 2.

$$Rx=5\ \Omega\cdot m/10\ \mu m\times 50\ \mu m/100\ \mu m$$

$$Ry=5\ \Omega\cdot m/10\ \mu m\times 80\ \mu m/160\ \mu m$$

If a line-width variation (±20 μm) of the resistor 3 in the column direction and a film-thickness variation (±5 μm) of the resistor 3 occur in the boundary portion between the metal back layers 2 and the resistor 3, resistance variations of the resistor Rx are respectively 6.67% and 3.23%. Thus, it can be understood that the resistance variations of the resistor Rx could be remarkably improved from the resistance variations (respectively, 20% and 9.1%) in the related background art.

When the withstand discharge test was performed by deteriorating a degree of vacuum of the inside by using the image displaying apparatus which used the relevant light emitter substrate, a fact that the discharge current was reduced to a level equal to or less than 1 A was confirmed. A secondary discharge by the potential difference occurred between the metal back layers 2 separated in the row and column directions did not occur. Also, a point defect did not occur at a discharge spot, and a condition before the discharge could be maintained. In addition, the anode potential drop when the image forming apparatus was driven reached a level equal to or less than 250V, and there was no problem also about the luminance deterioration on a visual confirmation.

Example 2

A light emitter substrate and an image displaying apparatus illustrated in FIG. 5 were manufactured in the same manner as that in the Example 1. This example is different from the Example 1 in point of the shape of a metal back. In this example, Al was used as metal back layers 2, and the resistance values of Rx=367 kΩ and Ry=250 kΩ were realized. More specifically, as illustrated in FIG. 5, the width (Mx) in the row direction of the metal back layer 2 was formed with a width of 160 μm. In addition, the separated distance (Gx) between the metal back layers 2 adjacent to each other in the row direction was formed with a distance of 50 μm and the separated distance (Gy) between the metal back layers 2 adjacent to each other in the column direction was formed with a distance of 50 μm. Additionally, the resistive material, of which the volume resistance is 5 Ω·m, was used as a resistor 3, and the width in the column direction of the resistor 3 was formed with a width of 220 μm and the film thickness was formed with a thickness of 10 μm. The width of the metal back layer 2 at the boundary portion between the metal back layer 2 and the resistor 3 was locally narrowed, the width (Mx') in the row direction was formed with a distance of 60 μm, and the width (Wx) in the column direction at the end portion of the metal back layer 2 was formed with a distance of 75 μm. Further, the width (Mx1) in the row direction at the end portion of the metal back layer 2 was formed with a distance of 100 μm. As a result, the separated distance (Gx') between the end portions of the metal back layers 2 adjacent to each other in the row direction is 110 μm. In this example, since the resistor 3 is formed at the end portion of the metal back layer 2, the resistance values of the resistors Rx and Ry are defined by the width and the length of the end portion of the metal back layer 2 and the distance between the end portions of the adjacent metal back layers 2.

$$Rx=5\ \Omega\cdot m/10\ \mu m\times 110\ \mu m/(75\times 2)\ \mu m$$

$$Ry=5\ \Omega\cdot m/10\ \mu m\times 50\ \mu m/100\ \mu m$$

If a line-width variation (±20 μm) of the resistor 3 in the column direction and a film-thickness variation (±5 μm) of the resistor 3 occur in the boundary portion between the metal back layers 2 and the resistor 3, resistance variations of the resistor Rx are respectively 9.78% and 4.67%. Thus, it can be understood that the resistance variations of the resistor Rx could be remarkably improved from the resistance variations (respectively, 20% and 9.1%) in the related background art.

When the withstand discharge test was performed by deteriorating a degree of vacuum of the inside by using the image displaying apparatus which used the relevant light emitter substrate, a fact that the discharge current was reduced to a level equal to or less than 1 A was confirmed. A secondary discharge by the potential difference occurred between the metal back layers 2 separated in the row and column directions did not occur. Also, a point defect did not occur at a discharge spot, and a condition before the discharge could be maintained. In addition, the anode potential drop when the image forming apparatus was driven reached a level equal to or less than 250V, and there was no problem also about the luminance deterioration on a visual confirmation.

As described above, the withstand discharge performance for the discharge of the light emitter substrate having the constitution capable of being manufactured in the process suitable for mass production and the withstand performance of the image displaying apparatus using the light emitter substrate could be confirmed.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-156644, filed Jun. 16, 2008, which is hereby incorporated by reference herein in its entirety.

What is claimed is:

1. A light emitter substrate which comprises a substrate, plural light emitting members which are positioned in matrix on the substrate, plural electrodes each of which covers at least one of the light emitting members and which are positioned in matrix, and a row-direction striped resistor which is positioned between the electrodes adjacent to each other in a column direction and connects the electrodes adjacent to others in a row direction and the column direction, wherein a row-direction separated distance between the electrodes adjacent to each other in the row direction in a connecting portion between the electrodes and the resistor at a position along an edge portion extending in the row direction of the resistor is larger than a row-direction separated distance between the electrodes adjacent to each other in the row direction in a portion covering the light emitting members, and wherein the row-direction separated distance between the electrodes adjacent to each other in the row direction in the connecting portion between the electrodes and the resistor at the position along the edge portion extending in the row direction of the resistor is larger than a row-direction separated distance between the electrodes adjacent to each other in the row direction in the connecting portion between the electrodes and the resistor at an edge portion in an end region extending in the column direction of the electrodes.

2. A light emitter substrate according to claim 1, wherein the row-direction separated distance between the electrodes adjacent to each other in the row direction in the end region extending in the column direction of the electrode is larger than the row-direction separated distance between the electrodes adjacent in the row direction at the portion covering the light emitting members.

3. An image displaying apparatus comprising:

a rear plate substrate having plural electron-emitting devices; and a light emitter substrate described in claim 1, wherein light emitting members of the light emitter substrate emit light in response to electrons emitted from the electron-emitting devices.

4. A light emitter substrate which comprises a substrate, plural light emitting members which are positioned in matrix on the substrate, plural electrodes each of which covers at least one of the light emitting members and which are positioned in matrix, and a row-direction striped resistor which is positioned between the electrodes adjacent to each other in a column direction and connects the electrodes adjacent to others in a row direction and the column direction, wherein, if it is assumed that a row-direction separated distance between the electrodes adjacent to each other in the row direction in a connecting portion between the electrodes and the resistor at a position along an edge portion extending in the row direction of the resistor is Gx', that a row-direction separated distance between the electrodes adjacent to each other in the row direction in a portion covering the light emitting members is Gx, and that a row-direction separated distance between the electrodes adjacent to each other in the row direction in the connecting portion between the electrodes and the resistor at an edge portion in an end region extending in the column direction of the electrodes is Gx1, relations Gx'>Gx and Gx'>Gx1 are satisfied.

* * * * *